US006533274B1

(12) United States Patent
Heggerty

(10) Patent No.: US 6,533,274 B1
(45) Date of Patent: Mar. 18, 2003

(54) INSTANT LOTTERY TICKET AND METHOD

(76) Inventor: Eugene Heggerty, 602 Woodthrush Ct., Mount Laurel, NJ (US) 08054

( * ) Notice: Subject to any disclaimer, the term of this patent is extended or adjusted under 35 U.S.C. 154(b) by 0 days.

(21) Appl. No.: 09/331,500

(22) PCT Filed: May 22, 1998

(86) PCT No.: PCT/US98/10709

§ 371 (c)(1),
(2), (4) Date: Feb. 4, 2000

(87) PCT Pub. No.: WO98/52661

PCT Pub. Date: Nov. 26, 1998

Related U.S. Application Data

(60) Provisional application No. 60/047,437, filed on May 22, 1997.

(51) Int. Cl.[7] ..... A63F 3/06; A63F 9/00

(52) U.S. Cl. ..... 273/139; 273/138.1; 273/138.2; 463/17; 463/41; 283/903

(58) Field of Search ..... 273/139, 138.1, 273/138.2, 274; 463/17, 18, 19, 42, 29, 41; 283/901, 903

(56) References Cited

U.S. PATENT DOCUMENTS 5,327,485 A * 7/1994 Leaden
5,475,205 A * 12/1995 Behm et al.

* cited by examiner

*Primary Examiner*—Benjamin H. Layno

(57) ABSTRACT

A ticket for and a method of conducting a probability game that can be used for instant lottery applications without the security risks normally associated with such games. Prior to generating the game tickets, the lottery or commercial entity decides what prizes they will offer and the frequency of those prizes appearing in the overall lottery. The total payout is determined based on standard statistical (probability) formulas. Based on this information, a computer is utilized to make a random selection of the number and/or symbol for each ticket that is that tickets winning number and the placement on the ticket of that winning number and/or symbol. Once the data is generated, an independent accounting firm verifies that each ticket does in fact contain a winner and that the placement of those winning numbers on the entire production run of tickets is without a pattern. When the verifications are completed satisfactorily, the tickets are printed and/or the data can be loaded to an on-line data base. The tickets consist of three separate parts, the game play portion containing numbers and symbols, a sequential ticket number and a validation number. The validation number is covered with an opaque, scratch off covering if the game is to be preprinted and sold in a continuous strip of tickets. If the game is used in an on-line game, the validation is not covered. The consumer can telephone to access the lottery computer and by using the telephone number pad to input the ticket data and the consumers number/symbol choice, learn the prize being offered with that particular ticket and whether or not the number/symbol selected is a winner. The consumer can then take the ticket to the ticket seller or other lottery center where the ticket can be verified as a winner by the seller and the prize paid.

2 Claims, 5 Drawing Sheets

INSTANT LOTTERY TICKET AND METHOD

This application claims benefit of provisional application 60/047,437 filed May 22, 1997.

BACKGROUND OF THE INVENTION

State Lotteries run a host of different products, the more popular of which can be categorized as either active, on-line games or passive games. Lotto, Keno, and three or four digit games are typical active, on-line games which offer the benefit of allowing the consumer to choose their own numbers, Consumers frequently use numbers that are meaningful to them, such as birth dates, addresses, or other numbers. By selecting their own numbers they are actively involved in the outcome. However, with such on-line games the consumer must wait for a drawing to determine if they have won.

Passive games consist of instant games and preprinted drawing games. In a typical instant game, a preprinted ticket, frequently referred to as a scratch ticket, contains a concealed game play. The consumer scratches off the entire concealment, revealing the game play, which may result in the consumer winning the prize printed on that ticket. The most common game play requires a match three of six prize amounts to win that prize. Consumers enjoy playing the instant ticket because they instantly know when they have won. However, the instant ticket is a passive product offering no true player involvement in the selection process.

There is, however, one type of instant game known as a probability game where the player can affect the outcome. In a probability game, every game ticket contains a winning combination, allowing the consumer to choose what they hope will be the winning combination. In a probability game the consumer is instructed to scratch off only a portion of the concealed game play. For example, an instant ticket could contain nine concealed blocks. The instructions would advise the consumer to remove the covering from only three blocks. If the same prize amount appears under all three blocks uncovered by the player, the player wins that prize. Player involvement is created since every ticket does contain a winning combination if the proper selection is made. Fast food restaurant, convenience stores, and supermarkets frequently use probability games for promotional purposes, but at these locations the prize is of limited value, e.g., a free soft drink. While this style of play is quite popular among consumers, its use is avoided by most state and commercial lotteries for substantial prizes because of the relative ease with which both consumers and retailers could compromise the ticket. This can be done by making small scratches in the covering in an effort to discern the data hidden below the covering. Although in theory a compromised ticket should be detectable by visual inspection or with the use of scanning equipment, many might escape detection and, even where detected, it would be difficult to prove if the scratches were made intentionally or accidentally though normal handling.

SUMMARY OF THE INVENTION

This invention comprises a ticket for and a method of conducting a probability game that can be used for instant lottery applications without the security risks normally associated with such games. Prior to generating the game tickets, the lottery or commercial entity decides what prizes they will offer and the frequency of those prizes appearing in the overall lottery. The total payout is determined based on standard statistical (probability) formulas. Based on this information, a computer is utilized to make a random selection of the number and/or symbol for each ticket that is that ticket's winning number and the placement on the ticket of that winning number and/or symbol. Once the data is generated, an independent accounting firm verifies that each ticket does in fact contain a winner and that the placement of those winning numbers on the entire production run of tickets is without a pattern. When the verifications are completed satisfactorily, the tickets are printed and/or the data can be loaded to an on-line data base.

These tickets consist of three separate parts, the game play portion containing numbers and symbols, a sequential ticket number and a validation number. The validation number is covered with an opaque, scratch off covering if the game is to be preprinted and sold in a continuous strip of tickets. If the game is used in an on-line game, the validation is not covered. The consumer can telephone to access the lottery computer and by using the telephone number pad to input the ticket data and the consumer's number/symbol choice, learn the prize being offered with that particular ticket and whether or not the number/symbol selected is a winner. The consumer can then take the ticket to the ticket seller or other lottery center where the ticket can be verified as a winner by the seller and the prize paid.

DETAILED DESCRIPTION

Figure 1:
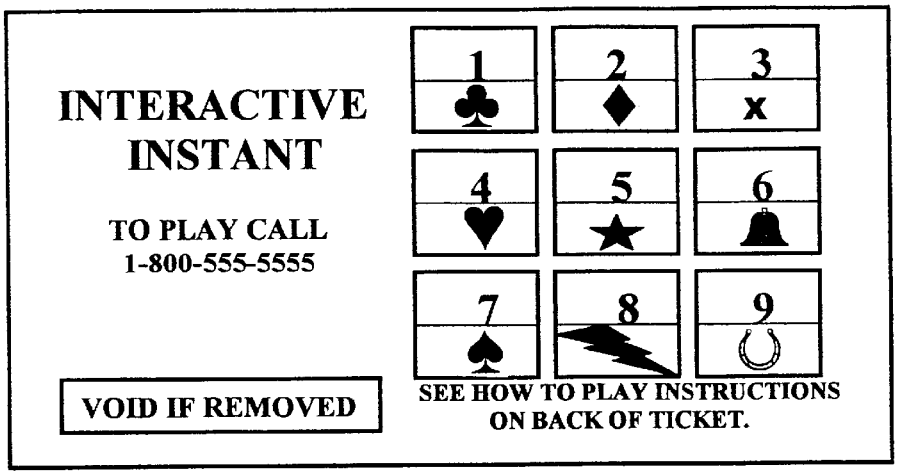
FIG. 1 illustrates the lottery ticket of the present invention with the validation number covered as in the case of preprinted tickets.

As shown in FIGS. 1 through 4, each lottery ticket contains nine numbers arranged in the same layout as found on the usual telephone keypad. If desired, the number of choices could be increased from nine to twelve by adding an additional (fourth) row with the designations *, 0, and # to correspond to the bottom row on the usual telephone keypad. Each number also may have a symbol assigned to it as shown in the drawings; this symbol adds to the play value for those consumers who associate "luck" with such symbols and who might prefer this option for attempting to select the winning number. The symbols associated with the numbers can be assigned at random during ticket printing so that on different tickets, different symbols will be associated with each number.

The prize amount varies by ticket. In the illustrations, the assigned prize amount is not printed on the ticket; if desired, however, the assigned prize amount could be printed and concealed on each ticket. The computer will also assign a non-sequential validation number for each ticket. It is this validation number that is used to access the data at the central computer. In the case of a lottery ticket, the ticket would be purchased at the same location where other lottery products are purchased. The retailer would use the same criteria for ticket sales as with other lottery products including a determination that the consumer is of legal age.

Figure 2:
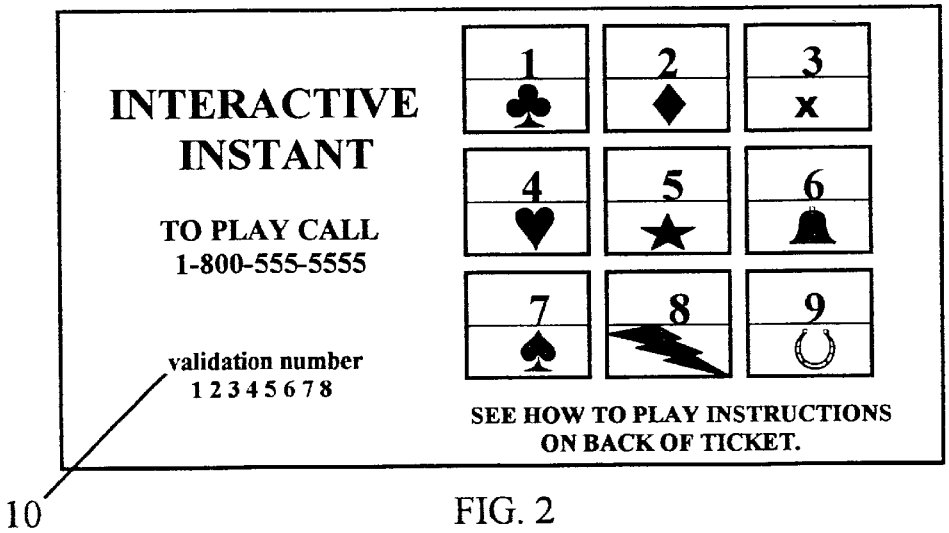
FIG. 2 illustrates the lottery ticket of he present invention with the validation number uncovered as in the case of on-line computer-generated tickets or as in the case where a preprinted ticket has had the validation number uncovered.
Figure 3:
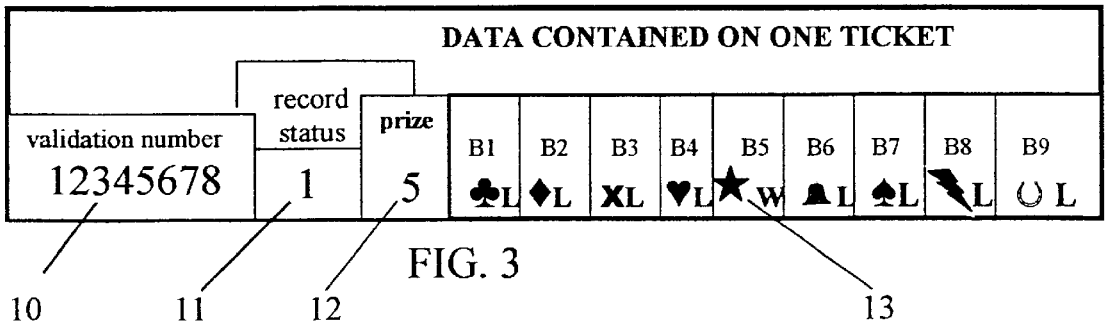
FIG. 3 is a schematic representation of the stored computer data relative to a particular lottery ticket of the present invention, in this case, the ticket of FIGS. 1 and 2.
Figure 4:
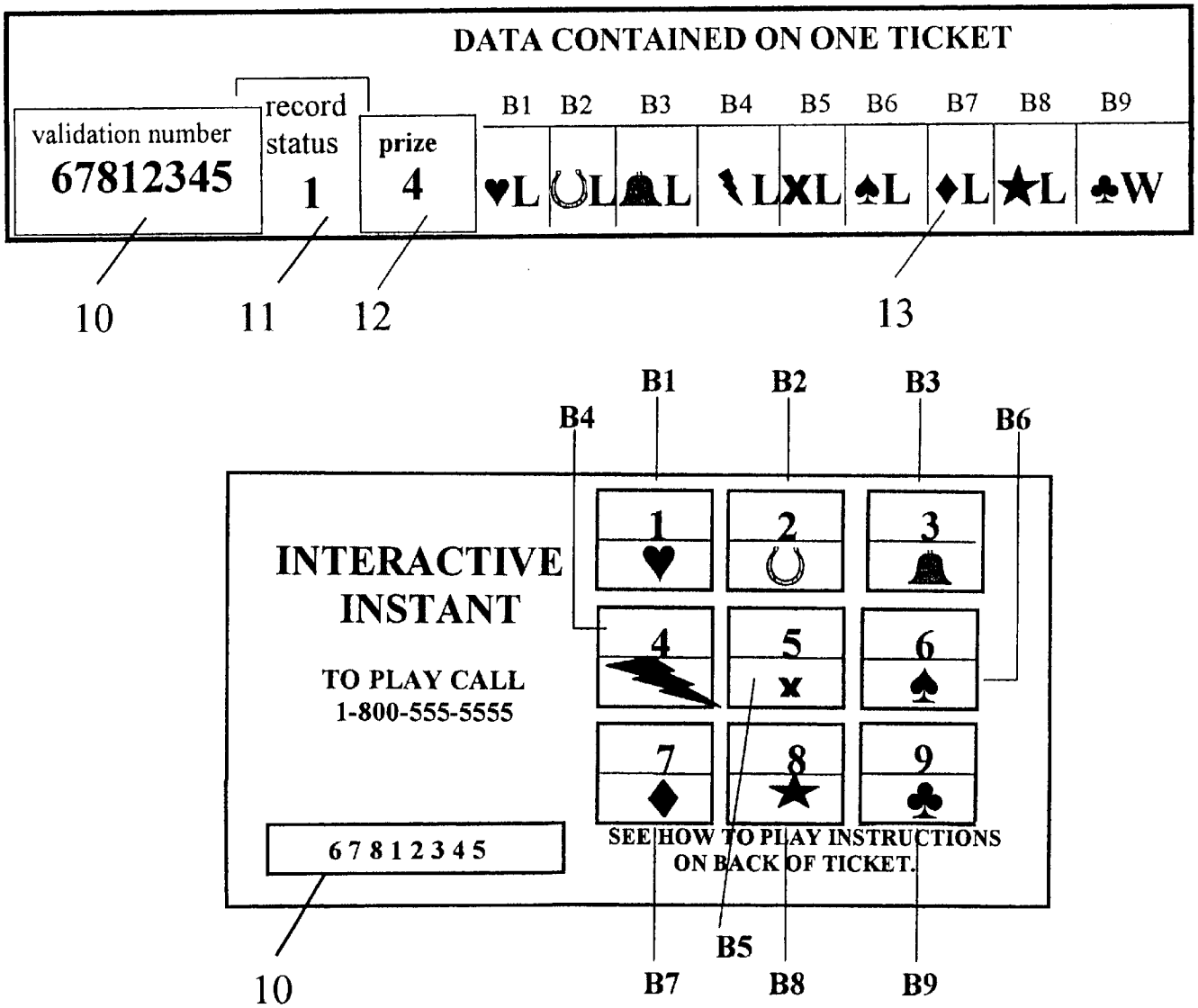
FIG. 4 illustrates a lottery ticket of the present invention different than that shown in FIG. 2 (the validation number uncovered), together with a schematic representation of the stored computer data for the lottery ticket.

With specific reference to FIGS. 2 through 4, each ticket is assigned its own unique validation number 10. This validation number is used to look up the data stored on that ticket when the player transmits the number by the telephone keypad to the lottery computer. The computer record for the ticket of the designated validation number contains a block of information which identifies the ticket's current status. As shown in the drawings, the status code records 11 indicate:

0=Not yet available for sale;

1=Available for sale;

2=This ticket was previously played and is a losing ticket;

3=This ticket was previously played and is a winner and the retailer is authorized to pay the prize amount for that ticket;

4=This ticket was previously played, redeemed and is now void.

The "prize" block of information 12 identifies the prize level that can be won. As an example:

1=Three dollar prize $3.00

2=Four dollar prize $4.00

3=Five dollar prize $5.00

4=Seven dollar prize $7.00

5=Ten dollar prize $10.00

6=Fifteen dollar prize $15.00

7=Twenty dollar prize $20.00

8=Fifty dollar prize $50.00

9=Seventy five dollars $75.00

0=Two hundred dollars $200.00

The "game play area" 13 is shown as nine blocks of information indicated by B1–B9. Each number corresponds to specific play choice on the ticket. Within each block appears a play symbol followed by L indicating this choice was a losing number or W indicating the winning number. FIGS. 1 through 3 illustrate one example of a ticket and the associated data that would be stored on the computer for that ticket and FIG. 4 illustrates another. The first example shown has a validation number of 12345678. In this example block 5 containing a star is the predetermined winning number for that ticket. If the player had selected (guessed) correctly by keying that number on the touch phone, the player would be entitled to win ten dollars. The second example shown has a validation number 67812345, and the winning number was 9 (the club symbol). If the player had selected correctly, the player would be entitled to win seven dollars.

Figure 5:
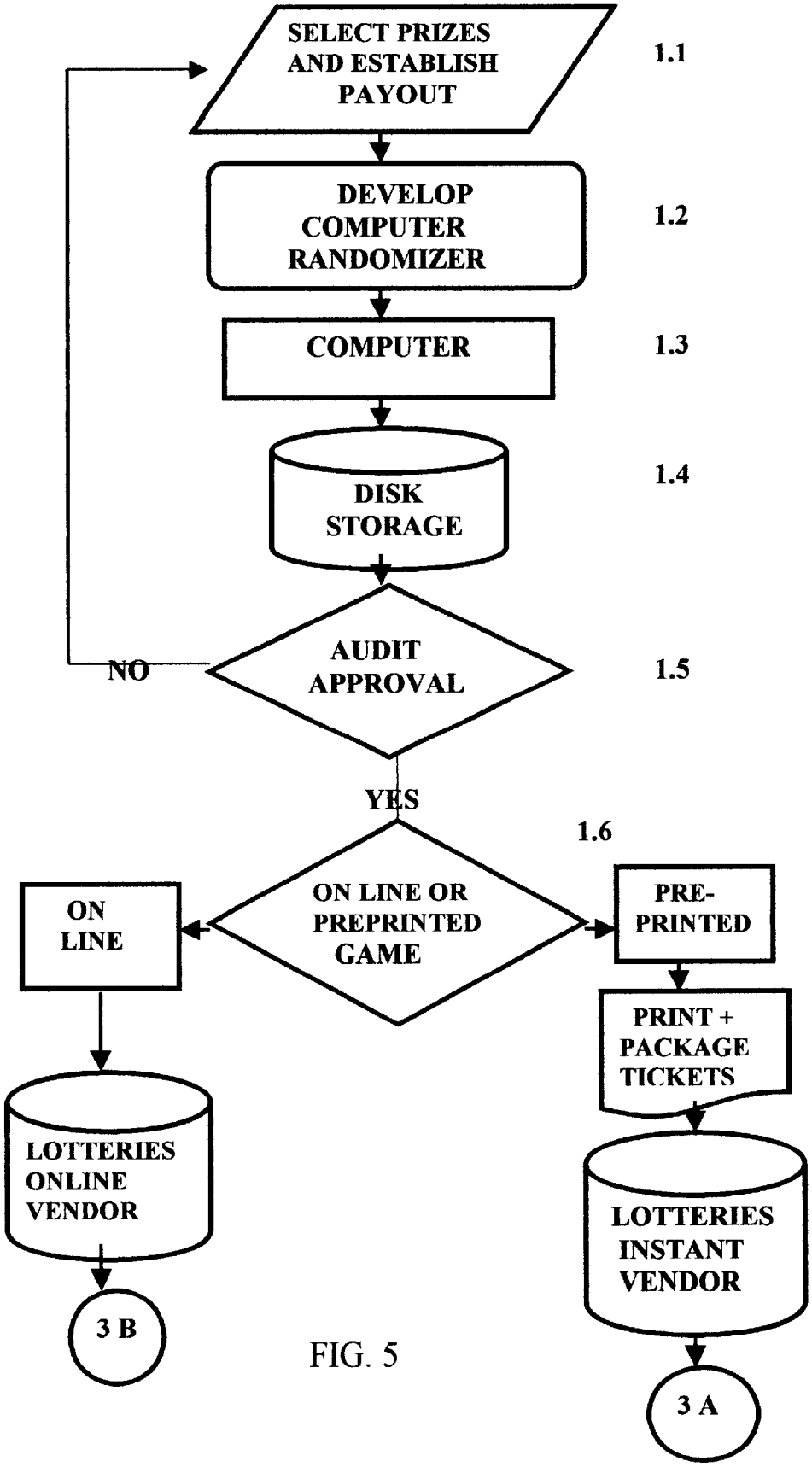
FIG. 5 is a schematic representation of the method used to set up a particular lottery game.

The initial setting up of the lottery game by the lottery sponsor is illustrated in the block diagram of FIG. 5. Block 1.1 represents the establishment of the overall details of the game, such as prize amounts, estimated payout game design, etc. Once approved the computer programmers activate a randomizer 1.2 to select the prizes, choose the winning digit and assign the corresponding symbols for each digit choice. At this time, each ticket is also assigned a unique validation number and sequential ticket number. Once the parameters are approved, the program is entered into the computer, the data generated, block 1.3, and stored on disk, block 1.4. Since each ticket does contain a winning symbol, the over all game prize liability or payout will vary dependent on the player selecting the correct digit Block 1.5 represents an independent audit to verify the absence of a pattern in the data. As shown in block 1.6, if the game is being used as a lottery product, the game can be distributed either through the use of a lotteries on line terminal such as the terminals currently used to distribute Lotto, or each ticket could be preprinted and packaged similar to instant tickets. If the lottery chooses to use its terminal to distribute the ticket, each ticket would be printed at the retail location at the time the player (consumer) pays for the ticket. Be it an instant or an on-line ticket, the general appearance and the data would be identical. If the game is an instant ticket, the validation number would be covered with an opaque covering as shown in FIG. 1.

Figure 6:
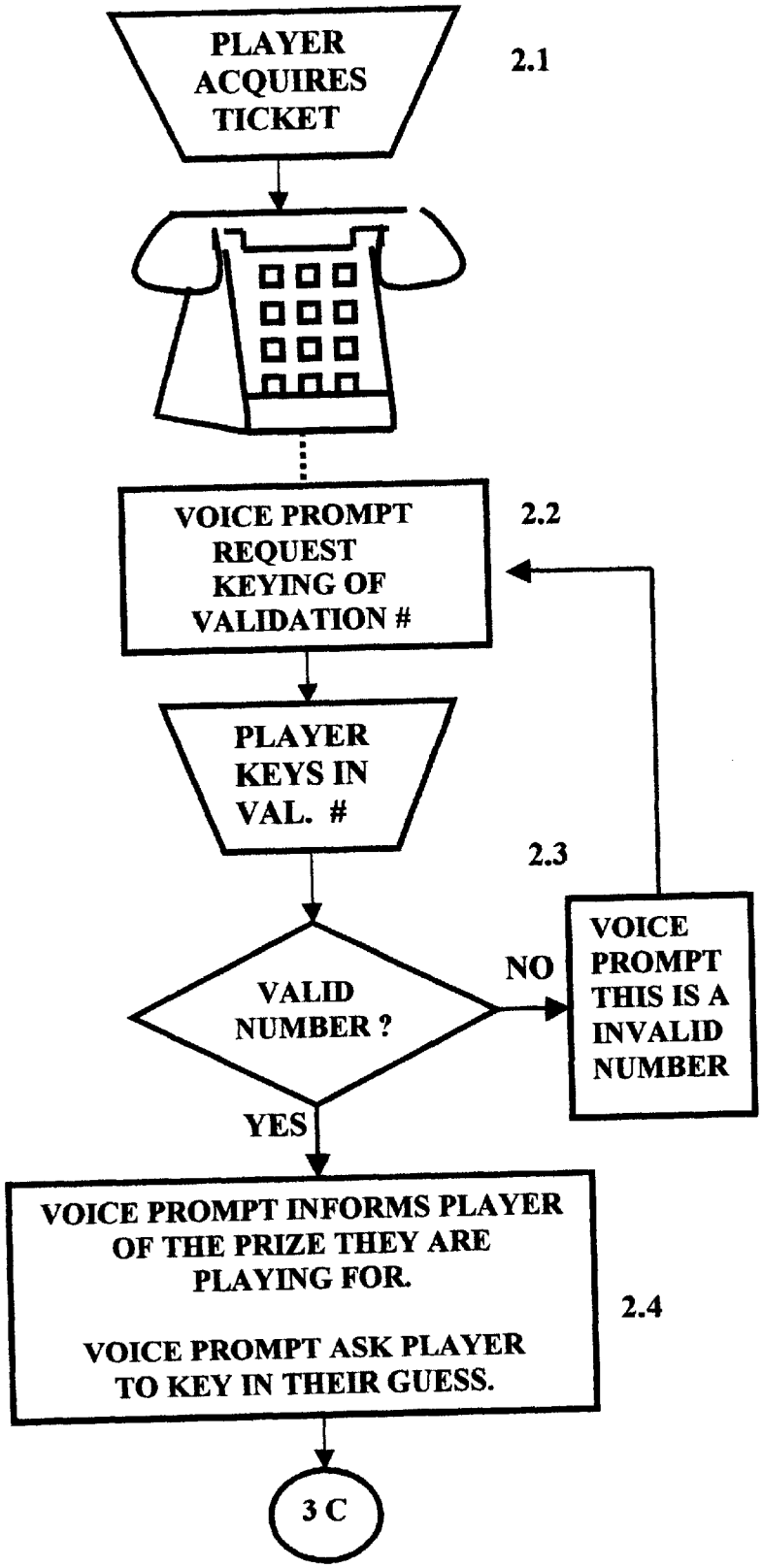
FIG. 6 is a schematic representation of the logic path of the consumer's (player's) participation in the lottery game of the present invention.

FIG. 6 illustrates in block diagram form the play of the game by the consumer. At block 2.1, the player acquires the ticket; if the game is a lottery product, the player would purchase the ticket at any auto lottery retailer location. If it is a commercial product the ticket would either be given to the consumer, or purchased at a gambling location such as a casino, Indian reservation, bingo hall, or other authorized location.

After reading the instructions on the ticket, the player using any touch-tone telephone keys in the 800 number printed on the ticket. A lottery is able to monitor the origin of the call and prevent any out of state access. An automated voice prompt, block 2.2, asks the player to key in the unique validation number for that ticket. The key in validation number is compared to the previously generated data stored on the computer and the computer verifies the number as a valid number, block 2.3, thereby identifying accidentally mis-keyed numbers. The computer also checks the status block to make certain that the ticket number wasn't previously played. The system will also determine if the validation number is from a ticket lot that was distributed and valid for sale, to reduce the risk of prank phone calls. To further insure against a person just keying in random numbers, the telephone system can be programmed to automatically disconnect the call after three attempts.

Once the system has determined that this ticket does contain a valid number, a voice prompt will inform the player, block 2.4, of the prize amount for which they are playing. A voice prompt will also ask the player to guess as to which of the nine numbers or symbols shown on that ticket is the winning number and to push (key) that corresponding number on the touch tone telephone.

Figure 7:
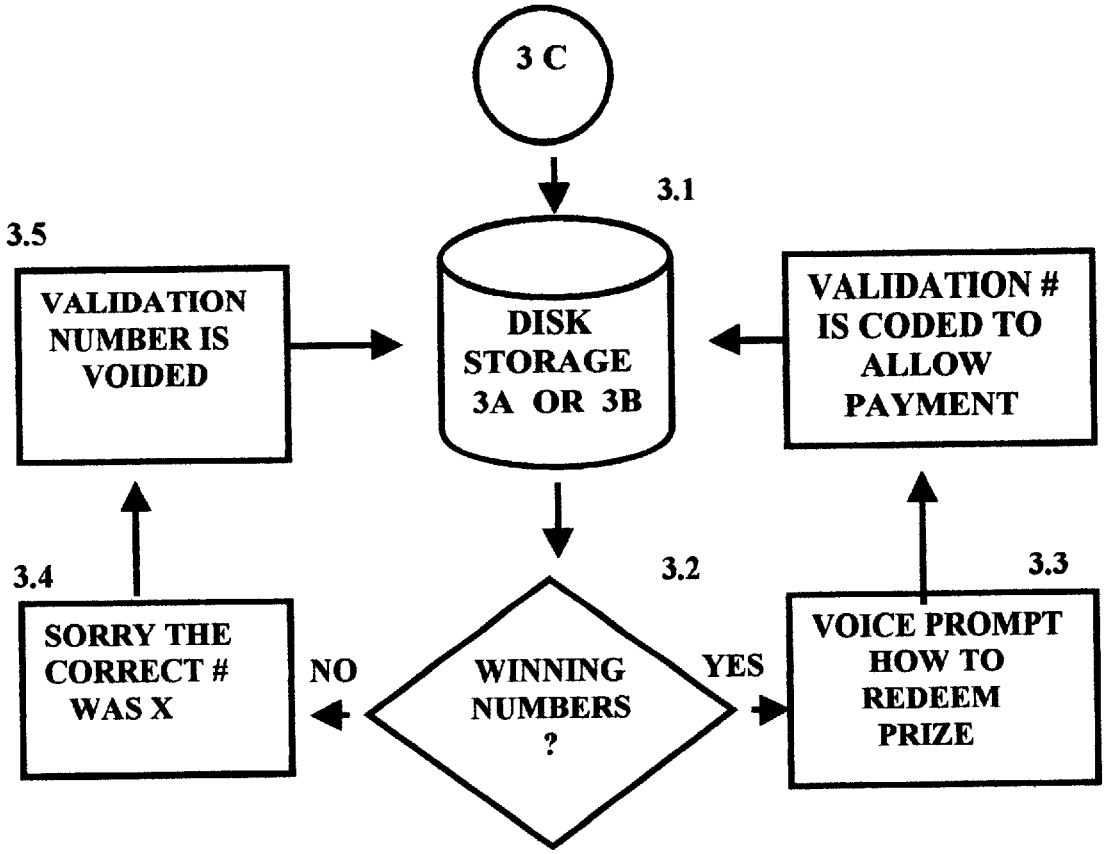
FIG. 7 is a schematic representation of the lottery computer's participation in the lottery game of the present invention in response to a telephone call from a player computer who has entered their play selection.

As shown in FIG. 7, when the player has selected and entered (keyed) the number choice, this data along with that ticket's validation number is compared, block 3.1, to the previously prepared data. The computer determines if the keyed in number is the winning number, block 3.2. If the player has guessed correctly, a voice prompt tells the player how to redeem the prize, block 3.3. The storage disk containing the winning ticket information is updated to allow payment when the player actually redeems the ticket. This same storage is again updated when the lottery retailer or commercial company has paid the player. If the player has incorrectly guessed, a voice prompt will tell the players which number and the associated symbol on that ticket that was the winning number, block 3.4. The computer storage unit, is updated, block 3.5, to prevent future access for that particular validation number.

Printed on each ticket are instructions for the consumer to call a lottery telephone number for access to the central lottery computer where the ticket data is stored. Once telephone connection is completed, a series of voice messages assist the consumer in playing the game. Typically, a voice message instructs the player to key in the validation number on that ticket. The central computer then accesses the previously created data containing the prize amount and the winning number. A voice prompt then informs the player of the amount they are playing for. The voice prompt asks the consumer to select one of the numbers shown on the ticket by pushing that corresponding number on the telephone. As an aid to prevent mis-keyed numbers, the voice prompt plays back the number the consumer has selected. The voice prompt then notifies the player if they have won. The voice prompt will also inform the winner to take the lottery ticket back to an authorized retailer for payment. Normally this is the location where the ticket was purchased.

When presented with the wining ticket, the retailer should first verify that they have ample money to pay the winner. The retailer then keys in the validation number or scans in the information and pays the customer. The ticket can be provided with a bar code so that the seller can simply pass the card through a bar code reader connected to the central lottery computer to verify the ticket, the amount of the winnings, and the status of the ticket. Once this is finished, the data at the central computer tags this ticket as paid.

It is important to note this invention is not limited to the specific embodiment shown. It is intended to encompass both the specific combination of tickets and computer records as well as the particular method of combining preprinted or computer-generated probability tickets that are played through the use of a telephone with a computerized system of generating, storing and utilizing lottery data forming the basis for the selection of the ticket winner.

What is claimed is:

1. A method of conducting a probability game that can be used for instant lottery applications without the security risks normally associated with such games comprising the steps of predetermining what prizes will be offered and the frequency of those prizes appearing in the overall lottery in which the total payout is determined based on standard statistical (probability) formulas; generating data on a plurality of lottery tickets, wherein each of said lottery tickets has a plurality of different numbers and/or symbols by utilizing, a computer to make a random selection of the number and/or symbol for each ticket including that ticket's winning number and the placement on the ticket of that winning number and/or symbol; once the data is generated, verifying that each ticket does in fact contain a winner and a predetermined prize and that the placement of those winning numbers on the entire production run of tickets is without a pattern; and printing the tickets loading the data into an on-line data base wherein the numbers and/or symbols on each of said tickets are never covered.

2. A lottery ticket consisting of three separate parts, the game play portion containing numbers and symbols, said numbers and symbols are never covered, a sequential ticket number and a validation number in which the validation number is covered with an opaque, scratch off covering when the game is preprinted and sold in a continuous strip of tickets, each ticket having a randomly assigned winning number, such that each ticket is a potential winning ticket and when the game is used in an on-line game, the validation is not covered, whereby the consumer can telephone to access a lottery computer and by using a telephone number keypad to input the ticket data and a player's number/symbol choice, and immediately learn the prize being offered with that particular ticket and whether or not the number/symbol selected is a winner and wherein the player can take the ticket to the ticket seller or other lottery center where the ticket can be verified as a winner by the seller and the prize paid.

* * * * *